United States Patent [19]

Klimpel et al.

[11] Patent Number: 4,732,668

[45] Date of Patent: Mar. 22, 1988

[54] NOVEL COLLECTORS FOR THE SELECTIVE FROTH FLOTATION OF MINERAL SULFIDES

[75] Inventors: Richard R. Klimpel; Robert D. Hansen; Edwin J. Strojny, all of Midland, Mich.

[73] Assignee: The Dow Chemical Company, Midland, Mich.

[21] Appl. No.: 860,163

[22] Filed: May 6, 1986

Related U.S. Application Data

[63] Continuation-in-part of Ser. No. 740,091, May 31, 1985, abandoned.

[51] Int. Cl.[4] ..... B03D 1/14

[52] U.S. Cl. ..... 209/166; 252/61

[58] Field of Search ..... 209/166, 167; 252/61; 549/1, 88

[56] References Cited

U.S. PATENT DOCUMENTS 3,071,593 1/1963 Warner ..... 549/1

3,822,288 7/1974 Labat et al. ..... 549/1

FOREIGN PATENT DOCUMENTS 113931 10/1941 Australia ..... 209/166

1300574 8/1969 Fed. Rep. of Germany ..... 549/88

*Primary Examiner*—Bernard Nozick

[57] ABSTRACT

This invention relates to a froth flotation process for selectively recovering nonferrous metal-containing sulfide minerals or sulfidized metal-containing oxide minerals from ores using froth flotation. The collector employed in the process is an epithio compound of the formula:

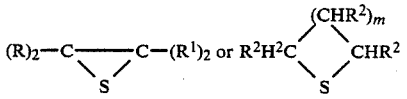

wherein m=1, 2 or 3; each R is independently hydrogen, a hydrocarbyl group or substituted hydrocarbyl group; each $R^1$ is independently hydrogen, a hydrocarbyl group or substituted hydrocarbyl group, provided one R or $R^1$ is not hydrogen; and each $R^2$ is independently hydrogen, hydrocarbyl, hydrocarbyloxy or hydrocarbyl thioether.

13 Claims, No Drawings

NOVEL COLLECTORS FOR THE SELECTIVE FROTH FLOTATION OF MINERAL SULFIDES

CROSS-REFERENCE TO RELATED APPLICATION

This application is a continuation-in-part of copending application Ser. No. 740,091, filed May 31, 1985 now abandoned.

BACKGROUND OF THE INVENTION

This invention relates to novel collectors for the recovery of metal-containing sulfide minerals and sulfidized metal-containing oxide minerals from mineral ores by froth flotation.

Flotation is a process of treating a mixture of finely divided mineral solids, e.g., a pulverulent ore, suspended in a liquid whereby a portion of such solids is separated from other finely divided mineral solids, e.g., clays and other like materials present in the ore, by introducing a gas (or providing a gas in situ) in the liquid to produce a frothy mass containing certain of the solids on the top of the liquid, and leaving suspended (unfrothed) other solid components of the ore. Flotation is based on the principle that introducing a gas into a liquid containing solid particles of different materials suspended therein causes adherence of some gas to certain suspended solids and not to others and makes the particles having the gas thus adhered thereto lighter than the liquid. Accordingly, these particles rise to the top of the liquid to form a froth.

Various flotation agents have been admixed with the suspension to improve the frothing process. Such added agents are classed according to the function to be performed: collectors, for sulfide minerals including xanthates, thionocarbamates and the like; frothers which impart the property of forming a stable froth, e.g., natural oils such as pine oil and eucalyptus oil; modifiers such as activators to induce flotation in the presence of a collector, e.g., copper sulfate; depressants, e.g., sodium cyanide, which tend to prevent a collector from functioning as such on a mineral which it is desired to retain in the liquid, and thereby discourage a substance from being carried up and forming a part of the froth; pH regulators to produce optimum metallurgical results, e.g., lime, soda ash and the like.

The phenomena which makes flotation a particularly valuable industrial operation appear to be largely associated with selective affinity of the surface of particulate solids, suspended in a liquid containing entrapped gas, for the liquid on the one hand, the gas on the other.

The specific additives used in the flotation operation are selected according to the nature of the ore, the mineral sought to be recovered, and the other additives which are to be used in combination therewith.

Flotation is employed in a number of mineral separation processes among which is the selective separation of metal-containing sulfide minerals such as those containing copper, zinc, lead, tin, molybdenum and other metals from sulfide minerals containing primarily iron such as pyrite or pyrrhotite.

Once recovered, the metal-containing minerals are converted to the more useful pure metal state, often by a smelting process. Such smelting processes can result in the formation of volatile sulfur compounds. These volatile sulfur compounds are often released to the atmosphere through smokestacks, or are removed from such smokestacks by expensive and elaborate scrubbing equipment.

Among collectors commonly used for the recovery of metal-containing sulfide or sulfidized metal-containing oxide minerals are xanthates, dithiophosphates, and thionocarbamates. Unfortunately, the xanthates, thionocarbamates, and dithiophosphates are not particularly selective in the recovery of sulfide or sulfidized oxide minerals. For example, many nonferrous metal-containing sulfide minerals are found naturally in ore which also contains iron-containing sulfide minerals. When the iron-containing sulfide minerals are recovered in flotation processes along with the nonferrous metal-containing sulfide minerals or sulfidized metal-containing oxide minerals, there is excess sulfur present which is released in the smelting processes resulting in an undesirably high amount of sulfur present during the smelting operations. The xanthates, thionocarbamates and dithiophosphates do not selectively recover nonferrous metal-containing sulfide minerals in the presence of iron-containing sulfide minerals. On the contrary, such collectors collect and recover all metal-containing sulfide minerals.

Other materials commonly recognized as useful in the recovery of sulfide-containing metal or sulfidized metal oxide values include mercaptans. Unfortunately, the mercaptan collectors have an environmentally undesirable odor, are very slow kinetically in the flotation of metal sulfides and do not selectively recover nonferrous metal sulfides in the presence of ferrous sulfides. Therefore, mercaptans are not generally used commercially.

It has also been proposed in U.S. Pat. No. 1,774,183 to use compounds of the formula $R—S_x—R'$ wherein R and R' stand for the same or different alkyl or aralkyl hydrocarbon radicals or groups such as $CH_3$, $C_2H_5$, $C_3H_7$, $C_4H_9$, $C_5H_{11}$, $C_6H_5CH_2$ or the like and x signifies the number 1 or a number greater than 1. (See, for example, U.S. Pat. No. 1,774,183.) Although the reference teaches that R and R' can be the same or different and that x can be 1, if x is 1, R and R' are the same in the only exemplified compounds. Moreover, of the described compounds, those of the formula R—S—S—R' are particularly preferred. The exemplified materials have not been found to be particularly selective in the recovery of metal-containing sulfide or oxidized metal-containing sulfide minerals, particularly those minerals which do not contain copper.

Similarly, U.S. Pat. No. 4,274,950 teaches using a compound of the formula R—S—R' wherein R and R' are the same or different and are a saturated or unsaturated organic radical. Although R and R' can be unsubstituted hydrocarbon radicals such as alkyl groups, the preferred compounds are substituted with either a hydroxy or carboxy group, e.g., are of the formulas $R—S(CH_2)_nOH$ or $R—S(CH_2)_n—COOR''$. All the specifically exemplified materials are substituted with a hydroxy or carboxy group except one compound wherein R is a $C_{12-18}$ alkyl group and R' is a $C_{1-6}$ alkyl group. Again, the exemplified materials have not been found to be particularly selective in the recovery of metal-containing sulfide or sulfidized metal-containing oxide minerals, particularly those minerals which do not contain copper.

In addition, the disulfides and higher sulfides are generally slow kinetically in the recovery of metal-containing sulfide minerals.

In view of the foregoing, a flotation collector which will selectively recover, at good rates and selectivity, metal-containing sulfide and sulfidized metal-containing oxide minerals, including the recovery of nonferrous metal-containing sulfide minerals or sulfidized metal-containing oxide minerals in the presence of sulfide or sulfidized oxide minerals containing primarily iron is desired.

SUMMARY OF THE INVENTION

Accordingly, this invention relates to a froth flotation process for selectively recovering metal-containing sulfide minerals or sulfidized metal-containing oxide minerals from mineral ores. More particularly, the method of the present invention comprises subjecting the mineral ore, in the form of an aqueous pulp, to a froth flotation process in the presence of a flotating amount of an organic compound of the formula:

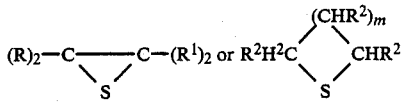

wherein each m=1, 2 or 3; and each R and $R^1$ are independently hydrogen, a hydrocarbyl or substituted hydrocarbyl provided at least one $R^1$ is not hydrogen; and each $R^2$ is independently hydrogen, hydrocarbyl, hydrocarbyloxy or hydrocarbyl thioether, under conditions such that the metal-containing sulfide mineral or sulfidized metal-containing oxide mineral is recovered.

Using the method of the present invention, a nonferrous metal-containing sulfide mineral or sulfidized metal-containing oxide mineral can be recovered at relatively high rates. In addition, relatively high selectivity toward nonferrous metal-containing sulfide minerals and sulfidized metal-containing oxide minerals is capable of being achieved when such metal-containing sulfide or sulfidized metal-containing oxide minerals are found in the presence of sulfide minerals containing primarily iron. These collectors demonstrate good recovery and good kinetics.

DETAILED DESCRIPTION OF THE INVENTION

The flotation collectors employed in the method of the present invention are organic compounds corresponding to the formula:

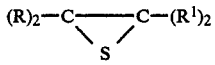

(I)

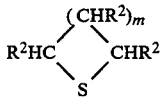

(II)

wherein m=1, 2 or 3, preferably 1 or 2; each R and $R^1$ are independently hydrogen, a hydrocarbyl group or substituted hydrocarbyl group, provided at least one $R^1$ is not hydrogen; and each $R^2$ is independently hydrogen, hydrocarbyl, hydrocarbyloxy or hydrocarbyl thioether, preferably hydrogen or hydrocarbyloxy. If substituted, R and $R^1$ are advantageously substituted with one or more hydroxy, cyano, ether, thioether, halo or hydrocarbyloxy moieties. Advantageously, the epithio compounds contain at least 4, more advantageously at least 6, carbon atoms and less than about 20, more advantageously less than about 16, carbon atoms.

Preferred flotation collectors are of formula (I). Preferably, in such formula, each R is independently hydrogen, an aliphatic, cycloaliphatic, aromatic group or combination thereof, unsubstituted or substituted with one or more hydroxy, ether, or thioether moieties, and each $R^1$ is independently hydrogen or aliphatic, cycloaliphatic, aromatic or combination thereof, unsubstituted or substituted with a hydroxy, ether or thioether. More preferably, one R is hydrogen and the other R is a $C_{2-20}$ aliphatic, aromatic or combination thereof, unsubstituted or substituted with a hydroxy, ether or thioether moiety and both $R^1$ are hydrogen or one $R^1$ is hydrogen and one $R^1$ is a $C_{1-5}$ hydrocarbyl group.

Of the compounds within the definition of formula (I), when R is a hydrocarbyl group substituted with an ether moiety, the compound can be represented by the general structural formula

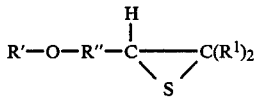

(Ia)

and when R is a hydrocarbyl substituted with a thioether moiety, the compound can be represented by the general structural formula

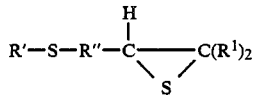

(Ib)

wherein R′ and R″ are independently hydrocarbyl group or substituted hydrocarbyl group. Preferably, R′ is an aliphatic, cycloaliphatic, aromatic or combination thereof having from 2 to about 15 carbon atoms, more preferably a $C_{2-10}$ alkyl group and R″ is a $C_{1-6}$ aliphatic group, more preferably a $C_{1-6}$ alkyl group, most preferably

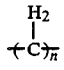

where n is an integer from 1 to 3.

The most preferred epithio collectors for use in the practice of this invention are compounds of the formula

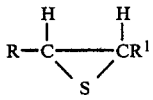

wherein R is a $C_{3-15}$ aliphatic, $C_{6-15}$ aromatic or combination thereof having from 6 to 15 carbon atoms and $R^1$ is hydrogen, or a $C_{1-3}$ alkyl. Most preferably R is $C_{4-10}$ aliphatic, $C_{6-10}$ aromatic or combination thereof having 6 to 12 carbon atoms and $R^1$ is hydrogen.

Examples of compounds within the scope of this invention include 2,3-epithiopropyl octyl sulfide; 7,8-epithio-1,2-octene; 1,2-epithiodecane; 1,2-epithiooctane; 1,2-epithiohexane; 1,2-epithiobutane; 3-t-butoxy-1,2-epithiopropane; 3-n-butoxy-1,2-epithiopropane; 3-phenoxy-1,2-epithiopropane and 1,2-epithio-5,6-hexene.

The method of this invention is useful for the recovery by froth flotation of metal-containing sulfide and sulfidized metal-containing oxide minerals from ores.

An ore refers herein to the metal as it is taken out of the ground and includes the metal-containing minerals in admixture with the gangue. Gangue refers herein to those materials which are of lesser or no value and are desirably separated from the metal-containing minerals.

Ores for which the method of this invention are useful include sulfide mineral ores containing copper, zinc, molybdenum, cobalt, nickel, lead, arsenic, silver, chromium, gold, platinum, uranium, and mixtures thereof. Examples of metal-containing sulfide minerals which may be concentrated by froth flotation using the method of the present invention include copper-bearing minerals such as covellite (CuS), chalcocite ($Cu_2S$), chalcopyrite ($CuFeS_2$), valleriite ($Cu_2Fe_4S_7$ or $Cu_3Fe_4S_7$), bornite ($Cu_5FeS_4$), cubanite ($Cu_2SFe_4S_5$), enargite ($Cu_3(As_1Sb)S_4$), tetrahedrite ($Cu_3SbS_2$), tennantite ($Cu_{12}As_4S_{13}$), brochantite ($Cu_4(OH)_6SO_4$), antlerite ($Cu_3SO_4(OH)_4$), famatinite ($Cu_3(SbAs)S_4$), and bournonite ($PbCuSbS_3$); lead-bearing minerals such as galena (PbS); antimony-bearing minerals such as stibnite ($Sb_2S_3$); zinc-bearing minerals such as sphalerite (ZnS); silver-bearing minerals such as stephanite ($Ag_5SbS_4$) and argentite ($Ag_2S$); chromium-bearing minerals such as daubreelite ($FeSCrS_3$); nickel-bearing minerals such as pentlandite [$(FeNi)_9S_8$]; molybdenum-bearing minerals such as molybdenite ($MoS_2$); and platinum- and palladium-bearing minerals such as cooperite ($Pt(AsS)_2$). Preferred metal-containing sulfide minerals include molybdenite ($MoS_2$), chalcopyrite ($CuFeS_2$), galena (PbS), sphalerite (ZnS), bornite ($Cu_5FeS_4$), and pentlandite [$(FeNi)_9S_8$].

Sulfidized metal-containing oxide minerals are minerals which are treated with a sulfidization chemical, so as to give such minerals sulfide mineral characteristics, so the minerals can be recovered in froth flotation using collectors which recover sulfide minerals. Sulfidization results in oxide minerals having sulfide characteristics. Oxide minerals are sulfidized by contact with compounds which react with the minerals to form a sulfur bond or affinity. Such methods are well-known in the art. Such compounds include sodium hydrosulfide, sulfuric acid and related salts such as sodium sulfide.

Sulfidized metal-containing oxide minerals and metal-containing oxide minerals for which this process is useful include oxide minerals containing copper, aluminum, iron, titanium, magnesium, chromium, tungsten, molybdenum, manganese, tin, uranium or mixtures thereof. Examples of metal-containing oxide minerals which may be concentrated by froth flotation using the process of this invention include copper-bearing minerals such as cuprite ($Cu_2O$), tenorite (CuO), malachite ($(Cu_2OH)_2CO_3$), azurite ($Cu_3(OH)_2(CO_3)_2$), atacamite ($Cu_2Cl(OH)_3$), chrysocolla ($CuSiO_3$); aluminum-bearing minerals such as corundum; zinc-containing minerals such as zincite (ZnO) and smithsonite ($ZnCO_3$); tungsten-bearing minerals such as wolframite [$(Fe, Mn)WO_4$]; nickel-bearing minerals such as bunsenite (NiO); molybdenum-bearing minerals such as wulfenite ($PbMoO_4$) and powellite ($CaMoO_4$); iron-containing minerals such as hematite and magnetite; chromium-containing minerals such as chromite ($FeOCr_2O_3$); iron- and titanium-containing minerals such as ilmenite; magnesium- and aluminum-containing minerals such as spinel; titanium-containing minerals such as rutile; manganese-containing minerals such as pyrolusite; tin-containing minerals such as cassiterite; and uranium-containing minerals such as uraninite, gummite ($UO_3nH_2O$) and pitchblende ($U_2O_5(U_3O_8)$).

In a preferred embodiment, metal-containing sulfide minerals are recovered. In a more preferred embodiment, the method of this invention is employed to recover sulfide minerals containing copper, nickel, lead, zinc, or molybdenum. In an even more preferred embodiment, sulfide minerals containing copper are recovered.

The collectors of this invention can be used in any concentration which gives the desired recovery of the desired mineral(s). The concentration at which the collector is most advantageously employed is dependent upon a variety of factors including the specific collector employed, the particular mineral(s) to be recovered, the grade of the ore to be subjected to the froth flotation process and the desired quality of the metal value to be recovered. Preferably, the collectors of this invention are used in concentrations of 0.001 kg to 1.0 kg per metric ton of ore, more preferably between about 0.010 kg and 0.2 kg of collector per metric ton of ore to be subjected to froth flotation.

During the froth flotation process of the present invention, frothers are preferably employed. Frothers are well-known in the art and reference is made thereto for the purposes of this invention. Any frother which results in the recovery of the desired metal value can be employed herein.

Frothers useful in this invention include any frothers known in the art which give the recovery of the desired mineral value. Examples of such frothers include $C_{5-8}$ alcohols, pine oils, cresols, $C_{1-4}$ alkyl ethers of polypropylene glycols, dihydroxylates of polypropylene glycols, glycols, fatty acids, soaps, alkylaryl sulfonates, and the like. Furthermore, blends of such frothers may also be used. All frothers which are suitable for beneficiation of mineral ores by froth flotation can be used in this invention.

In addition, in the method of this invention it is contemplated that collectors of this invention can be used in mixtures with other collectors well-known in the art. Collectors, known in the art, which may be used in admixture with the collectors of this invention are those which will give the desired recovery of the desired mineral value. Examples of collectors useful in this invention include alkyl monothiocarbonates, alkyl dithiocarbonates, alkyl trithiocarbonates, dialkyl dithiocarbamates, alkyl thionocarbamates, dialkyl thioureas, monoalkyl dithiophosphates, dialkyl and diaryl dithiophosphates, dialkyl monothiophosphates, thiophosphonyl chlorides, dialkyl and diaryl dithiophosphonates, alkyl mercaptans, xanthogen formates, xanthate esters, mercapto benzothiazoles, fatty acids and salts of fatty acids, alkyl sulfuric acids and salts thereof, alkyl and alkaryl sulfonic acids and salts thereof, alkyl phosphoric acids and salts thereof, alkyl and aryl phosphoric acids and salts thereof, sulfosuccinates, sulfosuccinamates, primary amines, secondary amines, tertiary amines, quaternary ammonium salts, alkyl pyridinium salts, guanidine, and alkyl propylene diamines.

Under preferred conditions, the recovery of the liberated iron sulfide in the froth is reduced by at least 10, more preferably at least 25, most preferably at least 40, percent when compared to mercaptan disulfide and polysulfide collectors.

The following examples are included for for purposes of illustration only and should not be construed to limit the scope of the invention or claims. Unless otherwise indicated, all parts and percentages are by weight.

In the following examples, the performance of the frothing processes described is shown by giving the rate constant of flotation and the amount of recovery at infinite time. These numbers are calculated by using the formula $$r = R\left[1 - \frac{1 - e^{-Kt}}{Kt}\right]$$

wherein: r is the fractional amount of mineral recovered at time t, K is the rate constant for the rate of recovery and R is the calculated fractional amount of the mineral which would be recovered at infinite time. The amount recovered at various times is determined experimentally and the series of values are substituted into the equation to obtain the R and K. The above formula is explained in Klimpel, "Selection of Chemical Reagents for Flotation", Chapter 45, pp. 907–934, *Mineral Processing Plant Design,* 2nd Ed., 1980, AIME (Denver) (incorporated herein by reference).

EXAMPLE 1

Froth Flotation of Copper-containing Sulfide Mineral

The method of the present invention is employed to run a series of trials using the various collectors as specified in Table I for flotation of copper-containing sulfide minerals. In each trial, a 500-g quantity of Western Canada copper ore, a relatively high grade chalcopyrite-containing ore with little pyrite, is placed in a rod mill having one-inch (2.5 cm) rods, with 257 g of deionized water and ground for 420 revolutions at a speed of 60 rpm to produce a size distribution of 25 percent less than 100 mesh. A quantity of lime is also added to the rod mill, based on the desired pH for the subsequent flotation. The ground slurry is transferred to a 1500 ml cell of an Agitair Flotation machine. The float cell is agitated at 1150 rpm and the pH is adjusted to 8.5 by the addition of further lime.

The specified collector is then added to the float cell (8 g/metric ton), followed by a conditioning time of one minute, at which time the frother, DOWFROTH® 250 (trademark of The Dow Chemical Company) is added (18 g/metric ton). After the additional one-minute conditioning time, the air to the float cell is turned on at a rate of 4.5 liters per minute and the automatic froth removal paddle is started. For purposes of comparison, samples of the copper-containing sulfide mineral ore are subjected to identical froth flotation conditions except using collectors not within the scope of the present invention.

The froth samples were taken off at 0.5, 1.5, 3, 5 and 8 minutes. The froth samples are dried overnight in an oven, along with the flotation tailings. The dried samples are weighed, divided into suitable samples for analysis, pulverized to insure suitable fineness, and dissolved in acid for analysis. The samples are analyzed using a DC Plasma Spectrograph. The results are compiled in Table I.

TABLE I

| Collector | Cu K | Cu R | Gangue K | Gangue R | Cu R-8[1] | Gangue R-8[1] | Selectivity[2] |
|---|---|---|---|---|---|---|---|
| potassium amyl xanthate[3] | 2.16 | 0.694 | 1.88 | 0.143 | 0.654 | 0.135 | 4.8 |
| butyl mercaptan[3] | 2.16 | 1.000 | 1.86 | 0.246 | 0.943 | 0.230 | 4.1 |
| hexyl mercaptan[3] | 0.89 | 0.961 | 0.82 | 0.216 | 0.850 | 0.187 | 4.5 |
| octyl mercaptan[3] | 0.56 | 0.765 | 0.52 | 0.160 | 0.571 | 0.118 | 4.8 |
| dodecyl mercaptan[3] | 0.31 | 0.552 | 0.30 | 0.129 | 0.341 | 0.079 | 4.3 |
| dipropyl disulfide[3] | 9.53 | 0.872 | 6.84 | 0.190 | 0.859 | 0.192 | 4.5 |
| dihexyl disulfide[3] | 3.21 | 0.569 | 2.34 | 0.113 | 0.543 | 0.109 | 5.0 |
| dioctyl disulfide[3] | 2.19 | 0.331 | 1.81 | 0.072 | 0.315 | 0.069 | 4.6 |
| didecyl disulfide[3] | 3.32 | 0.428 | 2.58 | 0.095 | 0.409 | 0.092 | 4.4 |
| dibenzyl tetrasulfide[3] | 2.26 | 0.310 | 1.94 | 0.067 | 0.298 | 0.064 | 4.7 |
| bis(1-amino-2-octyl)-sulfide[3] | 1.76 | 0.356 | 1.61 | 0.071 | 0.332 | 0.067 | 5.0 |
| N—(2-mercaptoethyl)-ethylamide[3] | 2.77 | 0.413 | 2.43 | 0.093 | 0.393 | 0.089 | 4.4 |
| diphenyl sulfide[3] | 2.40 | 0.365 | 1.77 | 0.081 | 0.348 | 0.078 | 4.5 |
| phenylmethyl sulfide[3] | 2.96 | 0.397 | 2.20 | 0.095 | 0.381 | 0.093 | 4.1 |
| dibutyl sulfide[3] | 5.94 | 0.930 | 4.95 | 0.194 | 0.902 | 0.188 | 4.8 |
| 2,3-epithiopropyloctyl sulfide | 2.26 | 0.794 | 1.69 | 0.175 | 0.746 | 0.163 | 4.6 |
| 7,8-epithio-1,2-octene | 5.75 | 0.904 | 3.64 | 0.182 | 0.899 | 0.184 | 4.9 |
| 1,2-epithio octane | 4.13 | 0.942 | 2.82 | 0.206 | 0.919 | 0.202 | 4.5 |
| 1,2-epithio decane | 3.89 | 0.918 | 2.50 | 0.189 | 0.902 | 0.186 | 4.8 |
| 1,2-epithio dodecane | 1.48 | 0.892 | 1.24 | 0.184 | 0.792 | 0.162 | 4.9 |
| 1,2-epithio hexane | 6.58 | 0.815 | 5.29 | 0.174 | 0.794 | 0.170 | 4.7 |
| 3-t-butoxy-1,2-epithio propane | 4.37 | 0.635 | 3.84 | 0.132 | 0.631 | 0.128 | 4.9 |
| 3-n-butoxy-1,2-epithio propane | 5.85 | 0.770 | 5.38 | 0.163 | 0.751 | 0.163 | 4.6 |
| 3-phenoxy-1,2-epithio propane | 5.23 | 0.477 | 4.95 | 0.115 | 0.464 | 0.113 | 4.1 |
| 1,2-epithio-5,6-hexene | 4.94 | 0.743 | 4.36 | 0.150 | 0.720 | 0.148 | 4.9 |
| 3-butoxy-thietane | 8.21 | 0.907 | 5.11 | 0.203 | 0.888 | 0.200 | 4.4 |

[1]R-8 is experimental recovery after 8 minutes
[2]Selectivity is calculated as the copper recovery at 8 minutes divided by the gangue at 8 minutes
[3]Not examples of the invention The method of this invention using the epithio collectors, in general, demonstrates higher rates and equilibrium recovery than methods using mercaptan and polysulfide collectors. Moreover, the mercaptans and polysulfides generally exhibit an environmentally unacceptable odor.

EXAMPLE 2

Froth Flotation of Copper/Molybdenum Ore

Bags of homogeneous ore containing chalcopyrite and molybdenite minerals are prepared with each bag containing 1200 g. The rougher flotation procedure is to grind a 1200-g charge with 800 cc of tap water for 14 minutes in a ball mill having a mixed ball charge (to produce approximately a 13 percent plus 100 mesh grind). This pulp is transferred to an Agitair 1500 ml flotation cell outfitted with an automated paddle removal system. The slurry pH is adjusted to 10.2 using lime. No further pH adjustments are made during the test. The standard frother is methyl isobutyl carbinol (MIBC). A four-stage rougher flotation scheme is then followed.

| | | |
|---|---|---|
| STAGE 1: | Collector | 0.0042 kg/ton |
| | MIBC | 0.015 kg/ton |
| | | condition - 1 minute |
| | | float - collect concentrate for 1 minute |
| STAGE 2: | Collector | 0.0021 kg/ton |
| | MIBC | 0.005 kg/ton |
| | | condition - 0.5 minute |
| | | float - collect concentrate for 1.5 minutes |
| STAGE 3: | Collector | 0.0016 kg/ton |
| | MIBC | 0.005 kg/ton |
| | | condition - 0.5 minute |
| | | float - collect concentrate for 2.0 minutes |
| STAGE 4: | Collector | 0.0033 kg/ton |
| | MIBC | 0.005 kg/ton |
| | | condition - 0.5 minute |
| | | float - collect concentrate for 2.5 minutes |

TABLE II

| | | Copper/Molybdenum Ore from Western Canada | | | | |
|---|---|---|---|---|---|---|
| Collector | Dosage kg/metric ton | Cu R-7[1] | Molyb R-7[1] | Ave Cu Grade[2] | Ave Mo Grade[2] | Ave Fe Grade[2] |
| A* | 0.0112 | 0.776 | 0.725 | 0.056 | 0.00181 | 0.254 |
| B | 0.0112 | 0.710 | 0.691 | 0.093 | 0.00325 | 0.149 |
| B | 0.0067 | 0.730 | 0.703 | 0.118 | 0.00390 | 0.115 |
| B | 0.0224 | 0.756 | 0.760 | 0.105 | 0.00346 | 0.161 |

A - potassium amyl xanthate
B - 1,2-epithiooctane
*Not an example of this invention
[1]R-7 is the experimental fractional recovery after 7 minutes
[2]Grade is the fractional content of the specified metal in total weight collected in the froth The method of the present invention has a significant influence both on improving the overall concentrate grade (the fraction of desired metal sulfide in the final flotation product) as well as a significant lowering of pyrite in the concentrate as measured by the lowering of the Fe assay of the product. This is true regardless of the dosage being used. This means less mass being fed to smelters and less sulfur emissions per unit of metal being produced.

EXAMPLE 3

Froth Flotation of Copper/Nickel Ore from Eastern Canada Containing Very High Amounts of Iron Sulfide Mineral in the Form of Pyrrhotite A series of samples are drawn from the feeders to plant rougher bank and placed in buckets to give approximately 1200 g of solid. The slurry contained chalcopyrite and pentlandite. The contents of each bucket are then used to perform a time-recovery profile on a Denver cell using an automated paddle and constant pulp level device with individual concentrates selected at 1.0, 3.0, 6.0 and 12.0 minutes. The chemicals are added once with a condition time of one minute before froth removal is started. The dosage of the collectors is 0.028 kg/ton of flotation feed. Individual concentrates are dried, weighed, ground and statistically representative samples prepared for assay. Time-related recoveries and overall head grades are calculated using standard mass balance equations.

TABLE III

| | Cu/Ni Ore from Eastern Canada | | | | | | | |
|---|---|---|---|---|---|---|---|---|
| | Cu | | Ni | | Cu | Ni | Pyrrhotite | Selectivity[2] |
| Collector | K | R | K | R | R-12[1] | R-12[1] | R-12[1] | |
| $C_5H_{11}OCS_2Na$[3] (sodium amyl xanthate) | 5.71 | 0.943 | 3.35 | 0.866 | 0.931 | 0.849 | 0.393 | 2.16 |
| $C_4H_9SC_4H_9$[3] | 9.61 | 0.937 | 2.95 | 0.656 | 0.928 | 0.630 | 0.190 | 3.32 |
| 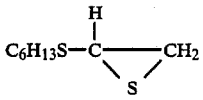 | 8.22 | 0.938 | 2.24 | 0.790 | 0.927 | 0.751 | 0.247 | 3.04 |

[1]R-12 is experimental recovery after 12 minutes
[2]Selectivity is calculated as the nickel recovery at 12 minutes divided by the pyrrhotite recovery at 12 minutes
[3]Not an example of the present invention As evidenced by the data set forth in Table III, the recovery of copper using the method of this invention is essentially equivalent to copper recovery using sodium amyl xanthate or $C_4H_9SC_4H_9$. Although the method of this invention results in a lower nickel recovery than sodium amyl xanthate, it also results in a much lower recovery of the undesired pyrrhotite. This is indicated by the $R_{12}$ value of pyrrhotite as well as the about 50 percent increase in selectivity of nickel sulfide over undesired iron sulfide. The method of the invention does, however, give a much greater Ni recovery than the method using $C_4H_9SC_4H_9$ as the collector.

EXAMPLE 4

Froth Flotation of A complex Pb/Zn/Cu/Ag Ore from Central Canada

Uniform 1000-g samples of ore are prepared. The ore contains galena, sphalerite, chalcopyrite and argentite. For each flotation run, a sample is added to a rod mill along with 500 cc of tap water and 7.5 ml of $SO_2$ solution. Six and one-half minutes of mill time are used to prepare a feed of 90 percent less than 200 mesh (75 microns). After grinding, contents are transferred to a cell fitted with an automated paddle for froth removal, and the cell attached to a standard Denver flotation mechanism.

A two-stage flotation is then performed. In Stage I a copper/lead/silver rougher, and in Stage II as zinc rougher. To start the Stage I flotation, 1.5 g/kg $Na_2CO_3$ is added (pH of 9 to 9.5), followed by the addition of collector(s). The pulp is then conditioned for 5 minutes with air and agitation. This is followed by a 2-minute condition period with agitation only. MIBC frother is then added (standard dose of 0.015 ml/kg). Concentrate is collected for 5 minutes of flotation and labeled as copper/lead rougher concentrate.

The Stage II flotation consists of adding 0.5 kg/metric ton of $CuSO_4$ to the cell remains of Stage I. The pH is than adjusted to 10.5 with lime addition. This is followed by a condition period of 5 minutes with agitation only. pH is then rechecked and adjusted back to 10.5 with lime. At this point, the collector(s) are added, followed by a 5-minute condition period with agitation only. MIBC frother is then added (standard dose of 0.020 ml/kg). Concentrate is collected for 5 minutes and labeled a zinc rougher concentrate.

Concentrate samples are dried, weighed, and appropriate samples prepared for assay using X-ray techniques. Using the assay data, recoveries and grades are calculated using standard mass balance formulae.

In addition to the above procedure, tests are also run at lower pH in Stage I (no $Na_2CO_3$ is added, giving a pH of 8.5) and in Stage II only enough lime is added to give a pH of 9.5. Also with the lower pH, 0.3 kg/metric ton of $CuSO_4$ is added.

TABLE IV

| | | | Pb/Zn/Cu/Ag Ore from Central Canada | | | | | | | | | |
|---|---|---|---|---|---|---|---|---|---|---|---|---|
| Test | Stage | Col- | Dosage | | Ag | | Cu | | Pb | | Zn | |
| # | (Rougher) | lector | (g/t) | pH | R-5 | Grade | R-5 | Grade | R-5 | Grade | R-5 | Grade |
| 1[1] | Cu/Pb | A | 5.0 | 9.5 | 0.868 | 0.267 | 0.935 | 0.109 | 0.787 | 0.052 | 0.208 | — |
| | | B | 7.5 | | | | | | | | | |
| | Zn | A | 20.0 | 10.5 | 0.069 | — | 0.038 | — | 0.089 | — | 0.774 | 0.474 |
| | | C | 15.0 | | | | | | | | | |
| 2 | Cu/Pb | D | 12.5 | 9.5 | 0.869 | 0.294 | 0.930 | 0.120 | 0.709 | 0.050 | 0.207 | — |
| | Zn | D | 35.0 | 10.5 | 0.079 | — | 0.039 | — | 0.154 | — | 0.772 | 0.447 |
| 3[1] | Cu/Pb | A | 5.0 | 8.5 | 0.843 | 0.286 | 0.926 | 0.120 | 0.738 | 0.053 | 0.179 | — |
| | | B | 7.5 | | | | | | | | | |
| | Zn | A | 20.0 | 9.5 | 0.109 | — | 0.057 | — | 0.155 | — | 0.808 | 0.314 |
| | | C | 15.0 | | | | | | | | | |
| 4 | Cu/Pb | D | 12.5 | 8.5 | 0.792 | 0.337 | 0.912 | 0.142 | 0.593 | 0.061 | 0.151 | — |
| | Zn | D | 35.0 | 9.5 | 0.145 | — | 0.068 | — | 0.275 | — | 0.829 | 0.414 |

[1]Not an example of the invention
A — sodium ethyl xanthate
B — dithiophosphate
C — thionocarbamate
D — 1,2-epithio octane
R-5 is the actual recovery after 5 minutes The data in Table IV indicates that the method of this invention can be employed using a single epithio collector to give equivalent or better performance than a method using 3 commercially optimized collectors at the normal pH and $CuSO_4$ selected as optimal for the commercial collectors (test nos. 1 and 2). The corresponding test nos. 3 and 4, conducted at lower pH and $CuSO_4$ levels also show similar results. The fact that this is true can represent significant savings in lime and $CuSO_4$ costs to a plant operation, as the main reason pH is controlled to 10.5 in Stage I and 9.5 in Stage II is to improve selectivity and the main reason for adding $CuSO_4$ is to improve Zn recovery while maintaining grade. Note that at the lower $CuSO_4$ runs (test no. 4), the method of this invention actually increases Zn recovery and maintains good grade.

EXAMPLE 5

A series of samples of ore containing galena, sphalerite, chalcopyrite and argentite are treated using the techniques of Example 4 using the various collectors and pH values specified in Table V. Each of the collected samples are evaluated as specified in Example 4. The results of the analysis are set forth in Table V.

TABLE V

| Test | Stage | Col- | Dosage | | Ag | | Cu | | Pb | | Zn | |
|---|---|---|---|---|---|---|---|---|---|---|---|---|
| No. | (Rougher) | lector | (g/metric t) | pH | R-5 | Grade | R-5 | Grade | R-5 | Grade | R-5 | Grade |
| 1[1] | Cu/Pb | A | 5.0 | 9.5 | 0.886 | — | 0.941 | — | 0.794 | — | 0.220 | — |
| | | B | 7.5 | | | | | | | | | |
| | Zn | A | 20.0 | 10.5 | 0.052 | — | 0.030 | — | 0.077 | — | 0.762 | |
| | | B | 15.0 | | | | | | | | | |
| 2[1] | Cu/Pb | D | 5.0 | 9.5 | 0.885 | — | 0.935 | — | 0.774 | — | 0.188 | — |
| | | B | 7.5 | | | | | | | | | |
| | Zn | D | 35.0 | 10.5 | 0.013 | — | 0.008 | — | 0.014 | — | 0.117 | — |
| 3 | Cu/Pb | E | 5.0 | 9.5 | 0.882 | — | 0.934 | — | 0.787 | — | 0.217 | — |
| | | B | 7.5 | | | | | | | | | |
| | Zn | E | 35.0 | 10.5 | 0.066 | — | 0.037 | — | 0.093 | — | 0.765 | — |

[1]Not an example of the invention
A — sodium ethyl xanthate
B — dithiophosphate (Aero ® 241 sold by American Cyanamid)
C — thionocarbamate (Minerac ® 2030 sold by Minerac Corp.)
D — $C_6H_{13}SC_6H_{13}$

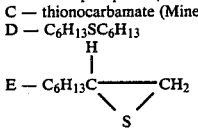

As evidenced by the data in Table V, the method of the present invention using an epithio collector exhibited equivalent results as the commercial prior art method (test no. 1) and superior lead and zinc recoveries as compared to a method using $C_6H_{13}SC_6H_{13}$ in place of the epithio collector.

EXAMPLE 6

Froth Flotation of a Copper Ore

When the procedure of Example 1 is repeated using a relatively high grade chalcopyrite-containing ore with little pyrite from a different location in the same mine as Example 1, the results as compiled in Table VI are obtained.

TABLE VI

| Collector | Cu K | Cu R | Gangue K | Gangue R | Cu R-8[1] | Gangue R-8[1] | Selectivity[2] |
|---|---|---|---|---|---|---|---|
| sodium sulfide[3] | 1.39 | 0.215 | 1.34 | 0.439 | 0.195 | 0.040 | 4.9 |
| ethylisopropyl sulfide[3] | 4.21 | 0.369 | 3.01 | 0.092 | 0.358 | 0.089 | 4.0 |
| ethylbutyl sulfide[3] | 9.52 | 0.765 | 6.46 | 0.174 | 0.750 | 0.172 | 4.4 |
| 1,2-epithio octane | 1.49 | 0.969 | 1.34 | 0.200 | 0.865 | 0.178 | 4.9 |

[1]R-8 is experimental fractional recovery after 8 minutes

[2]Selectivity is calculated as the copper recovery at 8 minutes divided by the gangue at 8 minutes

[3]Not an example of this invention

What is claimed is:

1. A method of recovering metal-containing sulfide minerals or sulfidized metal-containing oxide minerals from an ore which comprises subjecting the ore, in the form of an aqueous pulp, to a froth flotation process in the presence of a flotating amount of an organic compound of the general structural formula:

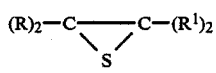

wherein each R and each $R^1$ is independently hydrogen, an aliphatic, cycloaliphatic, aromatic or combination thereof, unsubstituted or substituted with one or more hydroxy, ether, cyanogen, halogen or thioether moieties, provided at least one R or $R^1$ is not hydrogen and the epithio collector has at least 6 and less than 20 carbon atoms, under conditions such that the metal-containing sulfide mineral or sulfidized metal-containing oxide mineral is recovered in the froth.

2. The method of claim 1 wherein the epithio collector is present in a concentration of from 0.001 to 1.0 kg of collector/metric ton of ore to be subjected to froth flotation.

3. The method of claim 1 wherein one R is hydrogen and one R is a $C_{2-20}$ aliphatic, aromatic or combination thereof, unsubstituted or substituted with one or more hydroxy, ether or thioether moieties; and both $R^1$ are hydrogen or one $R^1$ is hydrogen and one $R^1$ is a $C_{1-5}$ hydrocarbyl group.

4. The method of claim 3 wherein the total number of carbon atoms in the epithio collector is at least 6 and less than 16.

5. The method of claim 1 wherein the epithio collector is a compound of the formula:

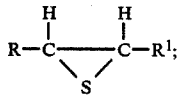

(a)

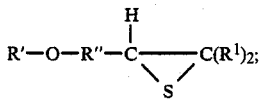

(b)

or

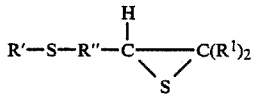

(c)

wherein R′ and R″ are independently an aliphatic, cycloaliphatic, aromatic or combination thereof, unsubstituted or substituted with one or more hydroxy, ether, cyanogen, halogen or thioether moieties.

6. The method of claim 5 wherein R′ is a $C_{2-10}$ alkyl group and R″ is

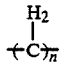

and n is an integer from 1 to 3.

7. The method of claim 2 wherein a metal-containing sulfide mineral is recovered in the froth.

8. The method of claim 7 wherein the metal-containing sulfide mineral recovered in the froth contains copper, zinc, molybdenum, cobalt, nickel, lead, arsenic, silver, chromium, gold, platinum, uranium or mixtures thereof.

9. The method of claim 8 wherein the epithio collector is a compound of the formula:

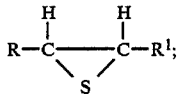

R is a $C_{3-15}$ aliphatic; and $R^1$ is hydrogen or a $C_{1-3}$ alkyl group.

10. The method of claim 9 wherein $R^1$ is hydrogen.

11. The method of claim 10 wherein R is a $C_{4-10}$ aliphatic.

12. The method of claim 1 wherein the metal-containing sulfide mineral recovered in the froth is molybdenite, chalcopyrite, galena, sphalerite, bornite or pentlandite.

13. The method of claim 12 wherein the sulfide collector is present in a concentration of from 0.001 to 1.0 kg of collector/metric ton of ore to be subjected to froth flotation.

* * * * *